US006581213B2

(12) United States Patent
Chiang

(10) Patent No.: US 6,581,213 B2
(45) Date of Patent: Jun. 24, 2003

(54) SWIMMING GOGGLES

(76) Inventor: Herman Chiang, 11F-7, No. 634-9 Ching-Ping Rd., Chung-Ho City, Taipei Hsien (TW)

( * ) Notice: Subject to any disclaimer, the term of this patent is extended or adjusted under 35 U.S.C. 154(b) by 0 days.

(21) Appl. No.: 09/954,115

(22) Filed: Sep. 11, 2001

(65) Prior Publication Data

US 2003/0046751 A1 Mar. 13, 2003

(51) Int. Cl.[7] ..... A61F 9/02
(52) U.S. Cl. ..... 2/428; 2/430
(58) Field of Search ..... 2/428, 452, 430; 24/163, 305, 579.11

(56) References Cited

U.S. PATENT DOCUMENTS 6,119,277 A * 9/2000 Chiang ..... 2/428
6,247,187 B1 * 6/2001 Chiang ..... 2/428
6,349,417 B1 * 2/2002 Chiang ..... 2/428

* cited by examiner

*Primary Examiner*—John J. Calvert
*Assistant Examiner*—Katherine Moran
(74) *Attorney, Agent, or Firm*—Troxell Law Office PLLC

(57) ABSTRACT

A pair of swimming goggles comprises a first and a second single-eye modules, each of which includes a lens frame that has lens units mounted thereon, a module nose bridge which is mounted on the side of the lens frame, a module strap which is mounted on opposition the module nose bridge, wherein the module nose bridge include at least a first connection set which is disposed on the lens frame, the first connection set have a first position portion and a nose body which can be connected to the first position portion. The module strap including a matching mean which is mounted on the lens frame, a join mean which can be engaged to the matching mean, a strap element which is assembled on the join mean, and a fastener having a first and a second jacket set which are mounted on the free end of the strap element, such that the user can chose the dual single-eye module which are respectively conformity with own each eye's diopter and can be easily assembled into a pair of swimming goggles when in use.

12 Claims, 5 Drawing Sheets

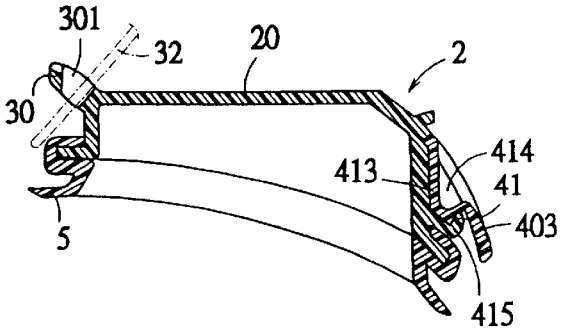
FIG.3 (3-3)
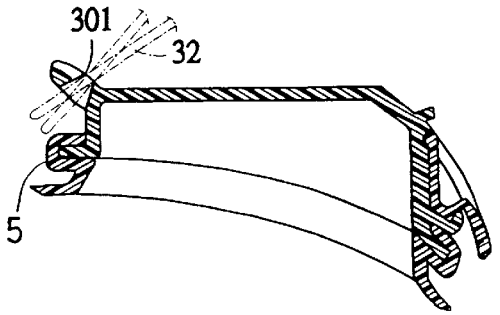
FIG.6
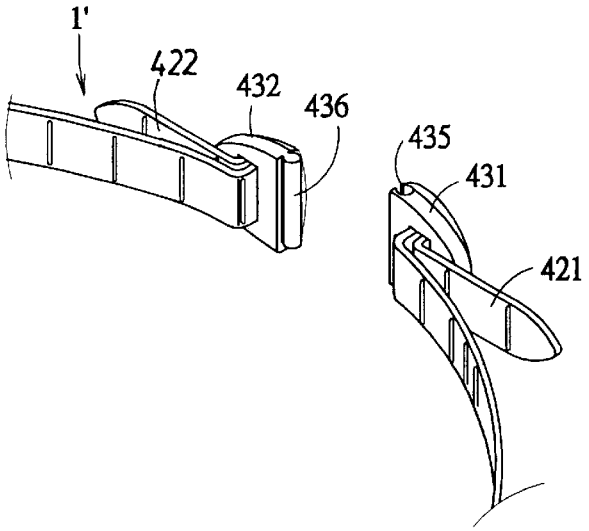
FIG.4
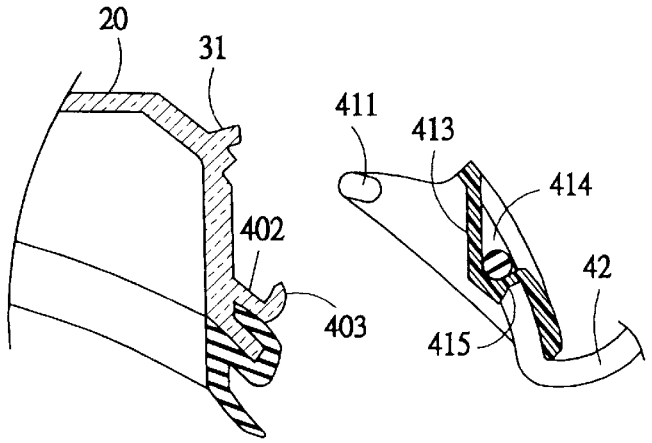
FIG.5

SWIMMING GOGGLES

FIELD OF THE INVENTION

The present invention relates to a swimming goggles, more particularly to a swimming goggles which has a first single-eye module and a second single-eye module and can be capable of dual assembly.

BACKGROUND OF THE INVENTION

Conventionally, there are two lens frames in a pair of swimming goggles and each of the lens frame has a lens unit which is no diopter. Nowadays, there is a diopter of a lens unit in a pair of swimming goggles that is a myopic swimming goggles, but the myopic swimming goggles can not conformity with customer due to each of the lens unit of the swimming goggles is the same diopter, but some user's eyes has different diopter, thereby causing some user need to buy a new single-eye lens frame to replace the unconformity one. However, it is difficult to the user that the single-eye lens frame was not easy to disassembly or assembly when the user replace it because a strap of a swimming goggles should be respectively passed through each of a lens frame and a fastener with a certain direction, lead to the user can not understand how to do and do not feel convenience. Moreover, it is wasteful that the single-eye lens frame can not continue to be used after it was replaced.

OBJECTS OF THE INVENTION

The object of the present invention is to provide a swimming goggles that can overcome the drawback of the aforementioned prior art.

The main object of the present invention is to provide a swimming goggles which has a first single-eye module and a second single-eye modules for facility dual assembly and provide user to choose what he or she want for match with own eye's dioter when the user buy a pair of swimming goggles.

To achieve the above objects, the present invention is characteristic in that a swimming goggles has a first single-eye module and a second single-eye modules for dual assembly, wherein each of the first and second single-eye module includes a lens frame that has a lens units mounted thereon, a module nose bridge mounted on the side of the lens frame, a module strap mounted on the lens frame opposite the module nose bridge, the module nose bridge includes at least a first connection assembly disposed on the edge of the lens frame, the first connection assembly has a first position portion and a nose body connectable thereto. The module strap includes a matching means mounted on the lens frame, a join means engaged to the matching means, a strap element assembled on the join means, and a fastener mounted on the free end of the strap.

Another features of the present invention is further to provide a second connection assembly having a second position portion disposed on the lens frame opposite the first connection assembly.

According to the above features of the present invention, the first position portion is two through holes or two clasp holes. The second first position portion is two clasp holes.

Further, according to the above features of the present invention, the nose body is a flexible strap which could be short or long, once the flexible strap is short, the lens frame just has a first connection assembly with two clasp holes on the inner side thereof, and the short flexible strap is clipped by either of the two clasp holes. Otherwise, the flexible strap is long, the lens frame has both a first connection assembly with two through holes and a second connection assembly with two clasp holes on both side thereof, such that the flexible strap passed through by either of the two through holes and clipped by either of the two clasp holes.

According to the above features of the present invention, the matching means includes two grooves in spaced relationship mounted on the lens frame, a post mounted between the two grooves and extending away from the lens frame remote from the lens unit, and the post has a hook which is bent toward the lens unit. The join means is an arch board which have protrusions positionable adjacent the two grooves of the matching means, a pass through portion positionable adjacent the post of the matching means having a recess, an opening and a stopper located on the end edge of the recess and positionable adjacent the hook of the post.

Moreover, the present invention is further featured in that the fastener includes a first jacket assembly and a second jacket assembly, wherein each of the first and second jacket assembly includes:

- a pass through portion for receiving the strap element having a socket and a pole mounted within the socket to separate the socket into two passing spaces;
- a first receiving portion being an elongated slot disposed on the end of the first jacket assembly, said elongated slot being open at a first end and closed at a second end; and
- a second receiving portion being a bar disposed on the end of the second jacket assembly whereby the bar is co-operable with the elongated slot such that the first and second single eye module are capable of dual assembly.

BRIEF DESCRIPTION OF THE DRAWINGS

Other features and advantages of the present invention will become apparent in the following detailed description of the preferred embodiments with reference to the accompanying drawings of which:

FIG. 3 is a section view of the single-eye module taken along line 3—3 in FIG.

FIG. 4 is a perspective view of disassembled of the first and second jacket set of the present invention;

FIG. 5 is section view of the matching mean and the join mean of the module strap of the present invention;

FIG. 6 is a section view of the first receiving portion of the second preferred embodiment;

DETAILED DESCRIPTION OF THE PREFERRED EMBODIMENT

Figure 8:
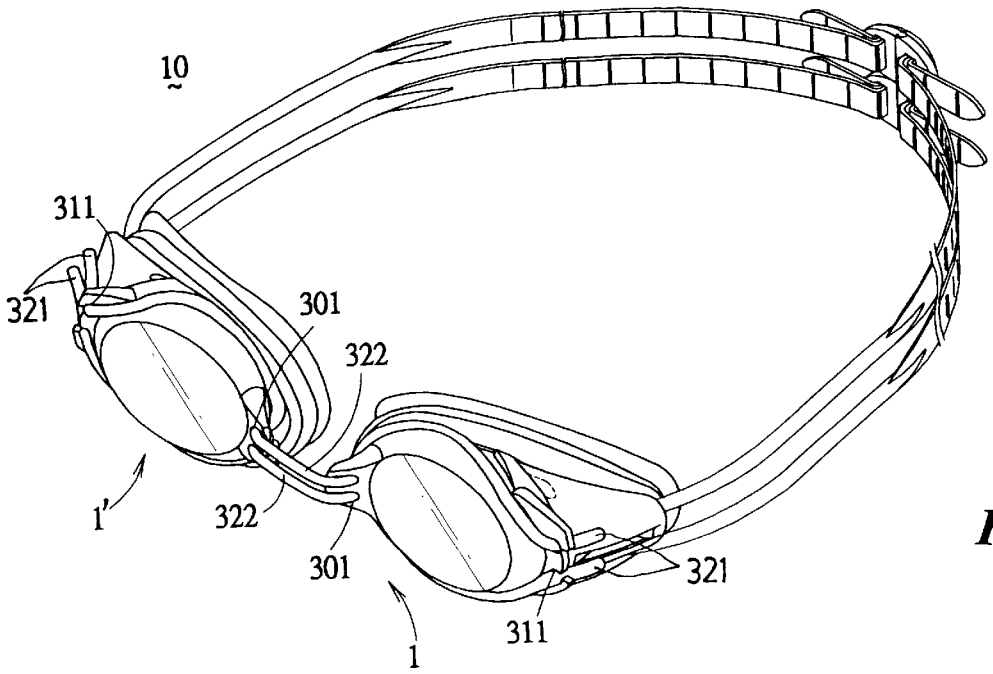
FIG. 8 is a perspective view illustrating the first and the second single-eye modules are assembled into a pair of swimming goggles of the present invention.

Referring now to the drawing, the swimming goggles of the present invention is illustrated in FIG. 8, the swimming goggles of the present invention comprises a first single-eye module land a second single-eye module 1', each of the first and the second single-eye modules 1, 1' are the same structures, here is just illustrated the first single-eye module 1 in FIGS. 1 to 6 in order to explain convenience and understanding. The first single-eye module 1 comprises a lens frame 2, a module nose 3 and a module strap 4, wherein the lens frame 2 have a lens unit 20 which is formed the front portion of the lens frame 2, and a lip 21 which is formed the outer periphery of the rear portion of the lens frame 2 that can be engaged a gasket 5 thereon.

Figure 1:
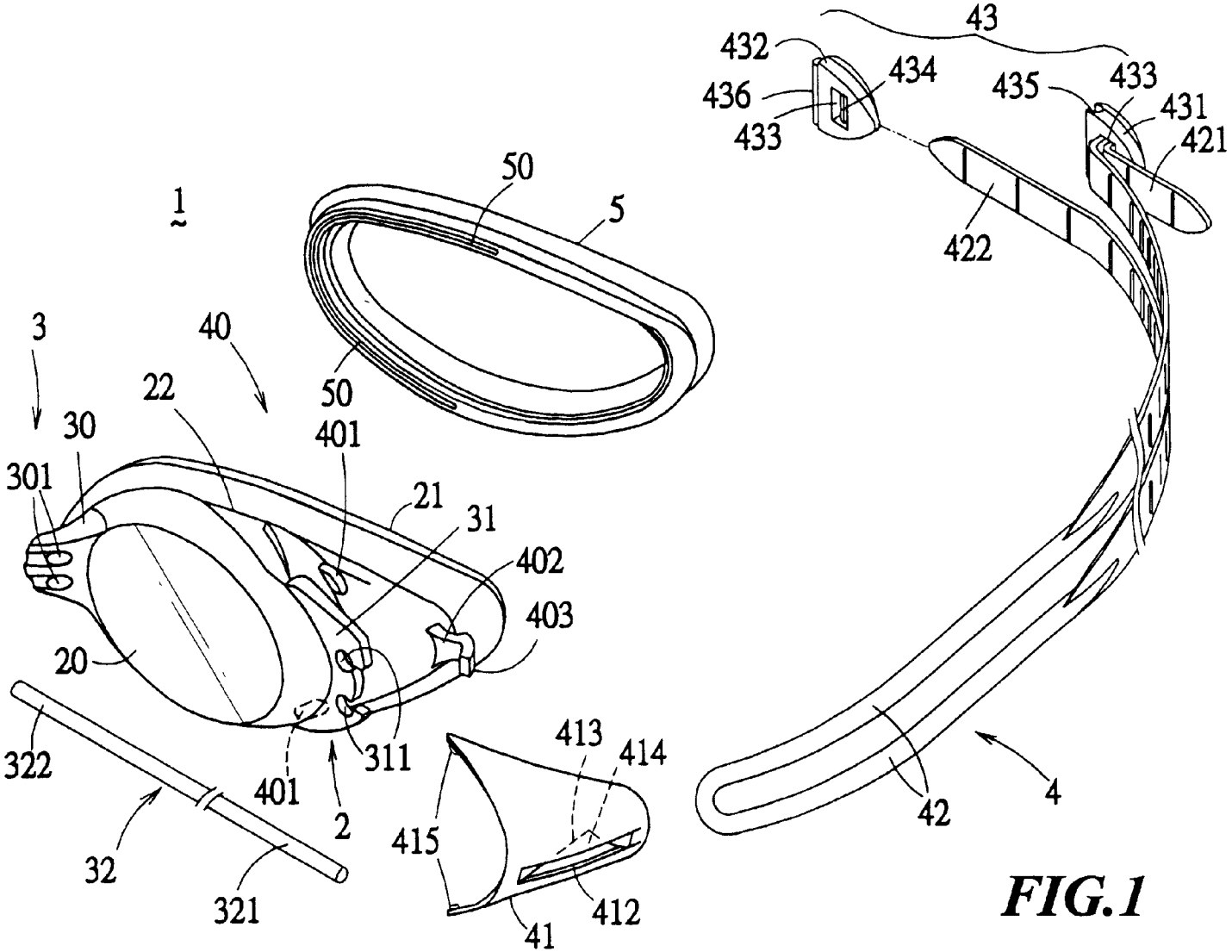
FIG. 1 is a perspective view of disassembled of the first preferred embodiment of single-eye module according to the present invention.
Figure 2:
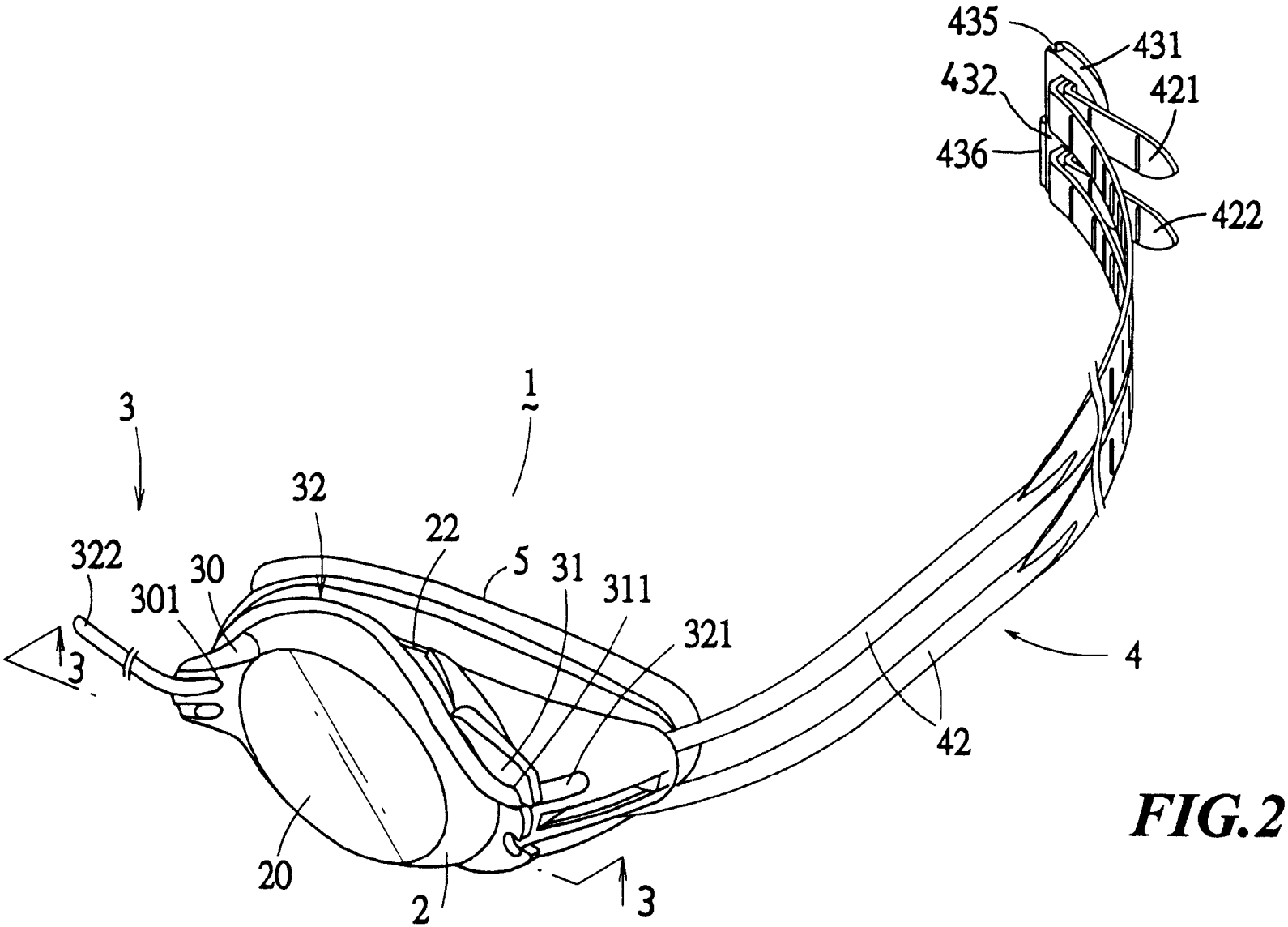
FIG. 2 is a perspective view of assembled of the first preferred embodiment of single-eye module according to the present invention.
Figure 7:
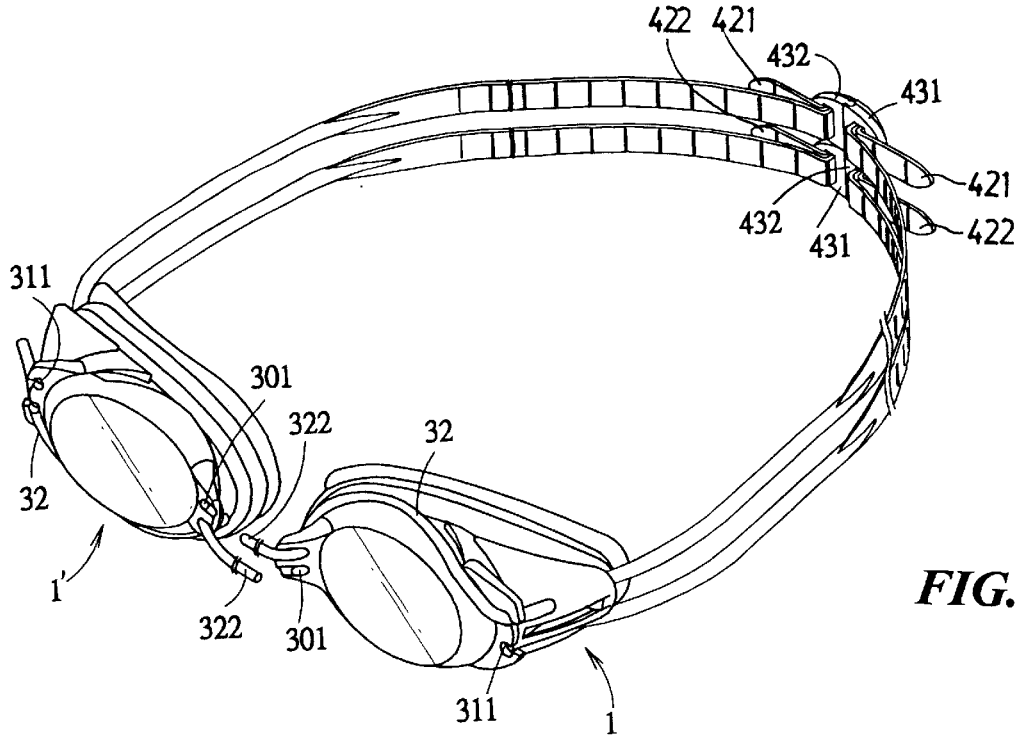
FIG. 7 is a perspective view illustrating the first and the second single-eye modules are disassembled of the present invention.

The module nose 3 includes a first connection assembly 30, a second connection assembly 31 and a nose body 32, wherein the first connection assembly 30 is formed extended from the lens frame 2 which has a first position portion is two through holes 301, referring to in FIG. 3, the through hole 301 is generally tapered that can be smoothly offered the nose body 32 passing through the through holes 301. The nose body 32 is a flexible strap which has two end 321,322, wherein the end of the flexible strap 321 can be passed through by either of the through holes 301 and can be posited by either of the clasp holes 311 as shown in FIG. 2, and the other end of the flexible strap 322 will be connected and matched the second single-eye module 1' as shown in FIG. 7 to FIG. 8. Moreover, between the first and the second connection assembly 30,31 have fixing groove 22 disposed on the outer periphery of the rear of the lens frame 2 and which can be served to the nose strap 32 position in the first and the second connection assembly 30,31 as shown in FIGS. 1 and 2. The gasket 5 has a annular groove 50 is capable of position the nose strap 32, the second connection assembly 31 formed the lens frame 2 which have two clasp 311 for clipping the nose body 32. Referring to FIG. 6, we can understand the nose body 32 can smoothly passed through the through holes 301, not contacting to the gasket 5.

Referring to in FIGS. 1 and 5, the module strap 4 includes a matching means 40, a join means 41, a strap element 42 and a fastener 43, wherein the matching means 40 includes two grooves 401 in spaced relationship mounted on the lens frame 2, a post 402 is mounted between the two grooves 401 and extending away from the lens frame 2 remote from the lens unit 20, the post 402 has a hook 403 which is bent toward the lens unit 20. The join means 41 is an arch board having protrusions 411 positionable adjacent the two grooves 401 that can match each other, and a pass through portion 412 is mounted on the arch board of the join means 41 positionable adjacent the post 402 of the matching means, and the through portion 412 has a recess 413, an opening 414 and a stopper 415 thereon, wherein the stopper 415 is located on the end edge of the recess 413 positionable adjacent the hook 403 of the post 402 of the matching means 40, such the above structure that the protrusions 411 will engage to the grooves 401, and the stopper 415 of the recess 413 will engage to the hook 403 of the post 402 while the join means 41 is assembled into the lens frame 2.

Referring once more to in FIG. 1, the strap element 42 is generally rubber material can be passed through the opening 414 of the join means 41 and two free end 421,422 of the strap element 42 posited on the same side of the join means 41 after the strap element 42 is assembled. The fastener 43 includes a first jacket assembly 431 and a second jacket assembly 432, each of the first and the second jacket assembly 431, 432 includes a pass through portion for receiving the strap element 42 having a first and a second receiving portion which are respectively mounted on the edge of the first and the second jacket assembly 431,432, and each of the pass through portion of the first and the second jacket assembly 431,432 respectively have a socket 433 and a pole 434 which is mounted within the socket 433 to separated the socket 433 into two passing space that can be capable of serving the strap element 42 passing through (The free end 421 of the strap 42 have assembled into the first jacket assembly 431 as shown in FIG. 1).

Moreover, The first receiving portion is an elongated slot 435 disposed on the edge of the first jacket assembly 431, and the end of the elongated slot 435 is open and the opposite end is close. The second receiving portion is a bar 436 disposed on the edge of the second jacket assembly 432 that can be matched with the elongated slot 435, such that both the first and the second jacket assembly 431,432 can easily match each other without direction.

Referring to FIGS. 7 to 8, during assembly, the user should be select the first single-eye module 1 and the second single-eye module 1' to conformity with the user's every eye, and then the first and the second jacket assembly 431,432 of the first and the second single-eye module 1,1' are mutually co-operable, by the elongated slot 435 match with the bar 436. Further, taking the free end 321 of each the nose body 32 of the first and the second single-eye module 1,1' passed through the through hole 301 of the first and the second connection assembly 30,31, and clipped by either of the two clasp holes 311 of the first and the second connection assembly 30,31. The other end 322 of each the nose body 32 of the first and the second single-eye module 1,1' are mutually co-operable such that the first and second single eye module are capable of dual assembly in FIG. 8.

Figure 9:
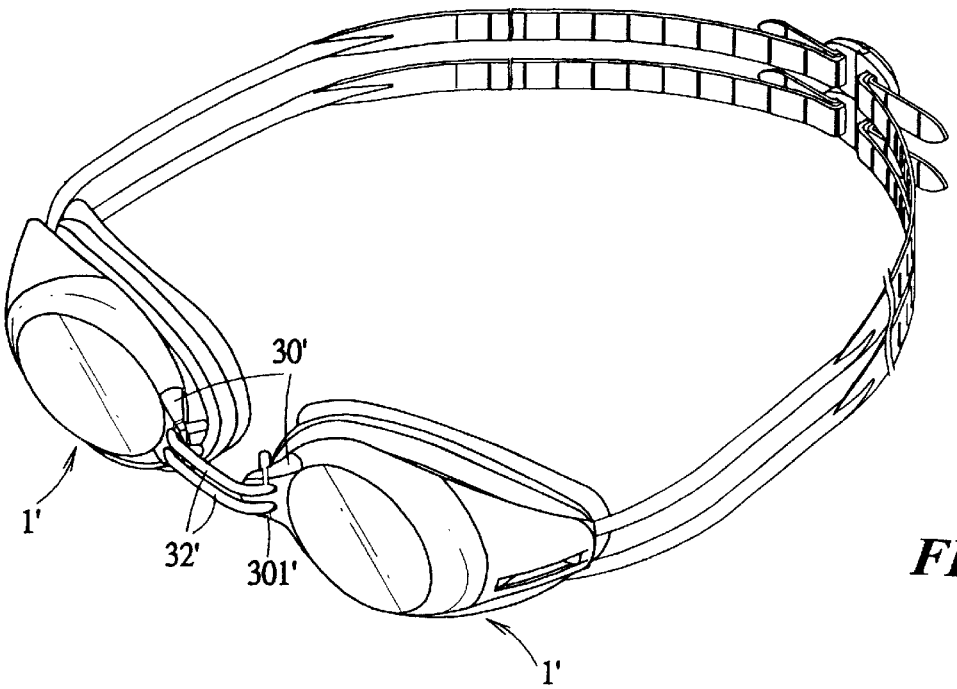
FIG. 9 is a perspective view of the second embodiment of swimming goggles according to the present invention.
Figure 10:
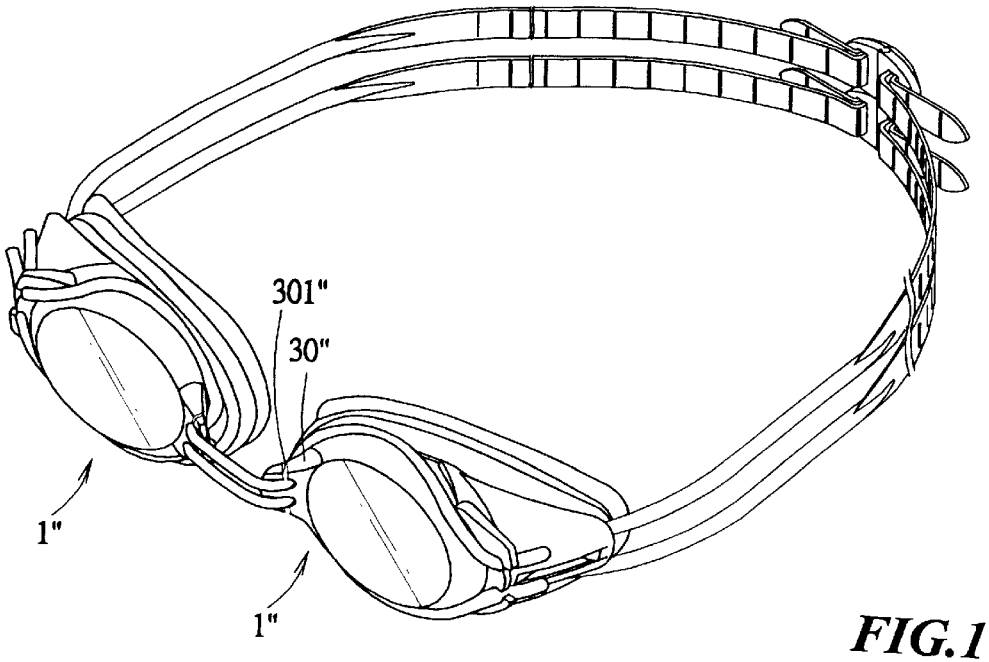
FIG. 10 is a perspective view of the third embodiment of swimming goggles according to the present invention.

Referring to FIGS. 9–10 illustrate the second and third embodiment of a pair of swimming goggles 1', 1" according to the present invention. As show in FIG. 9, the second embodiment is generally similar to the first preferred embodiment, but the first connection assembly 30' are two clasp holes 301' and cancel the second connection assembly, such structures make the nose body 32' will be short and can be easily assembled into a pair of swimming goggles.

As show in FIG. 10, the swimming goggles 1" is the third embodiment which is generally similar to the first preferred embodiment, but the first connection assembly 30' are two clasp holes 301', in other words, both the first and second connection assembly 30", 31", are two clasp holes 301", such structures can be easily assembled into a pair of swimming goggles .

While the present invention has been described in connection with what is considered the most practical and preferred embodiment, it is understood that this invention is not limited to the disclosed embodiments but is intended to cover various arrangements, included within the spirit and scope of the broadest interpretation so as to encompass all such modifications and equivalent arrangements.

What is claimed is:

1. A pair of swimming goggles comprising:

a first single-eye module and a second single-eye module for dual assembly, wherein each of the first and second single eye module includes:

a lens frame having a lens unit formed on the front portion thereof;

a module nose bridge having a first connection assembly disposed on the edge of the lens frame, said first connection assembly having a first position portion is two through holes, a second connection assembly having a second position portion is two clasp holes disposed on the lens frame opposite the first connection assembly, and a nose body is a flexible strap having a first and a second end passing through the through hole of the first position portion and clasped by the clasp hole of the second position portion;

a module strap having a strap element with a first and second free end and being connected to the side of the lens frame adjacent the nose body; and a fastener having a first jacket assembly and a second jacket assembly mounted respectively on the first and second free end of the strap element, each of the first and second jacket assembly includes:

a pass through portion for receiving the strap element having a socket and a pole mounted within the socket to separate the socket into two passing spaces;

a first receiving portion being an elongated slot disposed on the end of the first jacket assembly, said elongated slot being open at a first end and closed at a second end; and a second receiving portion being a bar disposed on the end of the second jacket assembly whereby the bar is co-operable with the elongated slot such that the first and second single eye module are capable of dual assembly;

whereby the first and second jacket assembly are mutually co-operable such that the first and second single eye module are capable of dual assembly.

2. The swimming goggles as claimed in claim 1 further comprising a matching mean mounted on the lens frame, and a join means engageable with the matching means and through which may be fed the strap element.

3. The swimming goggles as claimed in claim 2, wherein the matching mean includes two grooves in spaced apart relationship and a post mounted between the two grooves and extending away from the lens frame remote from the lens unit, the post has a hook which is bent toward the lens unit, and the join mean is an arch board having:

protrusions positionable adjacent the two grooves of the matching means, a pass through portion positionable adjacent the post of the matching means having a recess, an opening and a stopper located on the end edge of the recess and positionable adjacent the hook of the post, whereby the protrusions engage the grooves and the stopper engages the hook when the joining means is assembled onto the lens frame.

4. The swimming goggles as claimed in claim 3, wherein the two through holes of the first position portion is generally tapered.

5. The swimming goggles as claimed in claim 4 further comprising a fixing groove located between the first and the second connection assembly and which is disposed on the upper and lower portion of the outer periphery of the lens frame to support the nose body passing through the first and second connection assembly.

6. A single-eye module for dual assembly into a pair of swimming goggles comprising:

a lens frame having a lens unit formed on the front portion thereof, a module nose bridge having a first connection assembly extends from an inner edge of the lens frame, said first connection assembly having a first position portion is two clasp and a nose body is a flexible strap having a first and a second end, the first end is clipped by either of the two clasp holes of the first connection assembly and the second end is clippable by either of the two clasp holes of the first connection assembly of a second single eye module;

a module strap having a strap element with a first and second free end and being connected to the side of the lens frame adjacent the nose body; and a fastener having a first jacket assembly and a second jacket assembly mounted respectively on the first and second free end of the strap element, each of the first and second jacket assembly includes:

a pass through portion for receiving the strap element having a socket and a pole mounted within the socket to separate the socket into two passing spaces;

a first receiving portion being an elongated slot disposed on the end of the first jacket assembly, said elongated slot being open at a first end and closed at a second end; and a second receiving portion being a bar disposed on the end of the second jacket assembly whereby the bar is co-operable with the elongated slot such that the first and second single eye module are capable of dual assembly;

whereby the first and second jacket assembly are mutually co-operable such that the first and second single eye module are capable of dual assembly.

7. The single-eye module as claimed in claim 6, further comprising a matching mean mounted on the lens frame, and a join mean engageable with the matching means and through which may be fed the strap element.

8. The single-eye module as claimed in claim 7, wherein the matching means includes two grooves in spaced apart relationship and a post mounted between the two grooves and extending away from the lens frame remote from the lens unit, wherein the post has a hook which is bent toward the lens unit.

9. The single-eye module as claimed in claim 8 wherein the join means is an arch board having:

protrusions positionable adjacent the two grooves of the matching means, a pass through portion positionable adjacent the post of the matching means having a recess, an opening and a stopper located on the end edge of the recess and positionable adjacent the hook of the post, whereby the protrusions engage the grooves and the stopper engages the hook when the joining means is assembled onto the lens frame.

10. The single-eye module as claimed in claim 9 further comprising a lip on the outer periphery of the rear portion of the lens frame for receiving a gasket.

11. The single-eye module as claimed in claim 10 further comprising a fixing groove is located between the first and the second connection assembly and which is, disposed on the upper and lower portion of the outer periphery of the lens frame to support the nose body passing through the first and second connection assembly.

12. The single-eye module as claimed in claim 6, wherein further comprising a second connection assembly having a second position portion is two clasp holes disposed on the lens frame opposite the first connection assembly, such that the first and/the second end of the nose body are respectively passing through and clasped by, the clasp hole of the first and the second position portion.

* * * * *